United States Patent [19]

Suzuki et al.

[11] 4,106,611

[45] Aug. 15, 1978

[54] SERIAL PRINTING APPARATUS

[75] Inventors: Takami Suzuki; Nobuo Iwata, both of Tokyo, Japan

[73] Assignee: Ricoh Company, Ltd., Tokyo, Japan

[21] Appl. No.: 644,987

[22] Filed: Dec. 29, 1975

[30] Foreign Application Priority Data

| | | | |
|---|---|---|---|
| Dec. 28, 1974 | [JP] | Japan | 50/1291 |
| Aug. 6, 1975 | [JP] | Japan | 50/94954 |
| Aug. 18, 1975 | [JP] | Japan | 50/99933 |

[51] Int. Cl.[2] ..... B41J 1/30

[52] U.S. Cl. ..... 400/144.2; 400/174

[58] Field of Search ..... 197/6.7, 18, 49, 53, 197/54; 101/93.18, 93.19; 64/17 SP; 403/58

[56] References Cited

U.S. PATENT DOCUMENTS

| | | | |
|---|---|---|---|
| 3,212,290 | 10/1965 | Walden | 64/17 SP |
| 3,643,774 | 2/1972 | Kondur | 197/53 X |
| 3,651,915 | 3/1972 | Folkens | 197/53 |
| 3,651,916 | 3/1972 | Becchi | 197/54 |
| 3,677,386 | 7/1972 | Herterich et al. | 197/53 |
| 3,884,340 | 5/1975 | Tramposch et al. | 197/36 X |
| 3,893,390 | 7/1975 | Deproux | 101/111 |
| 3,921,277 | 11/1975 | Tramposch | 197/53 X |
| 3,921,787 | 11/1975 | Fujio et al. | 197/53 |
| 3,935,937 | 2/1976 | Tramposch | 197/53 |
| 3,941,229 | 3/1976 | Becchi et al. | 197/53 |

FOREIGN PATENT DOCUMENTS

| | | | |
|---|---|---|---|
| 2,132,345 | 1/1972 | Fed. Rep. of Germany | 197/53 |
| 2,159,261 | 8/1972 | Fed. Rep. of Germany | 197/53 |

*Primary Examiner*—Paul T. Sewell

*Attorney, Agent, or Firm*—Frank J. Jordan

[57] ABSTRACT

Resilient tongues project from a central hub and carry two or more type members. The hub is rotated to a position in which the tongue carrying the desired type member is in a printing position facing a paper supporting platen. The hub is then shifted along the axis of the selected tongue so that the required type member is in a printing position. A drive motor for rotating the hub is connected to the hub by a universal joint to compensate for the shifting of the hub. The universal joint comprises a biased presser member to eliminate lost motion in the rotational direction. A stopper member is provided so that the bending characteristics of the selected tongue are the same no matter which type member is selected. A hammer drives the type member against the paper to print. The resilient tongues are formed of a thermoplastic resin mixed with glass or carbon fibers and the type members may be formed separately from the tongues, fixed thereto and plated with metal. The hub may be formed in two or more sections, with each section carrying some of the resilient tongues. The tongues are bent in such a manner that all of the type members lie in a common plane. The angles between the type members and the tongues are selected in such a manner that all of the type members strike the paper perpendicular to the platen.

12 Claims, 15 Drawing Figures

SERIAL PRINTING APPARATUS

The present invention relates to a serial printing apparatus comprising a printing member having a hub supporting resilient tongues which carry type members.

In the type of serial printer disclosed in U.S. Pat. No. 3,707,214 to Ponzano, a type wheel comprises a rotary hub. Resilient tongues extend radially from hub and carry type members at their ends, one on each tongue. The hub is rotated until the tongue carrying the type member formed with the desired character for printing is in a printing position facing a platen which supports paper. A hammer then drives the type member against the paper through an inked ribbon to print the character on the paper resiliently deforming the tongue in the process. Such an apparatus is highly advantageous compared to a ball, cylinder or multihead printer in that the tongue and type member are very light, and can be moved faster, with less noise and smaller energy. A printing apparatus of this type can reduce the noise level from between 75 to 85 phones which are common to printers of other types down to below 70 phones.

Whereas the apparatus disclosed by Ponzano is adequate in applications where the number of characters required for printing is low, for example the numerals 0 to 9 and a few symbols, for upper and lower case alphabet in addition to numerals and punctuation marks required in a standard typewriter, the length of the tongues must be increased to an impractical value to accommodate all of the characters. If the sizes of the type members and tongues are reduced to provide a more compact configuration, the rigidty of the apparatus will not be sufficient for practical use. This prior art apparatus is completely insufficient if a printing apparatus which must include the Japanese Katakana characters (about 50 in number) in addition to the Roman alphabet is required.

The apparatus may be operated in either of two ways. The hub may be rotated continuously and sensor means provided to actuate the hammer when the required tongue is in the printing position. In this case, the hammer holds the type member against the paper momentarily for printing while the hub continues to rotate. The tongue must therefore bend both toward the paper and in the rotary direction of the tongue. Spring metal tongues do not readily allow such bending in the rotational direction and introduce unacceptable vibration into the apparatus.

Alternatively, the hub may be rotated to the printing position by a stepping motor and stopped. In this case, the tongue is stationary when the hammer moves it, and is not required to bend in the rotary direction. On the contrary, the tongues must be rigid in the rotational direction to withstand the extreme acceleration and deceleration and not oscillate around the stopping point. In prior art apparatus, such rigid tongues have a high moment of inertia which limits the operational speed of the apparatus.

The same problem affects the durability of the type members. Whereas metal type members are extremely durable, they are heavy and limit the operational speed of the apparatus as discussed above. Integral tongues and type members formed of metal do not have sufficient elasticity. If an integral tongue and type member is formed of a thermoplastic resin to provide elasticity, the service life of the type member will only be 1,000,000 to 3,000,000 cycles. Whereas a type member formed of a thermosetting resin such as epoxy provides a service life of 10,000,000 to 20,000,000 cycles, a thermosetting resin cannot be used for the tongues since it is rigid. Due to the hygroscopic properties of thermoplastic and thermosetting resins, whereas thermosetting resins may be metal plated, the service life of thermoplastic resins except for special formulas such as TYPE 66 NYLON (trade name) thermoplastic cannot be increased by metal plating.

It is therefore an object of the present invention to provide a serial printing apparatus by which the number of type members available for practical use may be increased over the prior art.

It is another object of the present invention to provide a serial printing apparatus in which two or more type members are provided on each tongue.

It is another object of the present invention to provide a serial printing apparatus comprising two or more hubs supporting tongues and type members, the tongues being bent in such a manner that the type members lie in a common plane in their free state.

It is another object of the present invention to provide a serial printing apparatus in which a hub carrying tongues is both rotated and shifted to select a desired type member, the means for rotating the hub being connected to the hub through a universal joint which compensates for the shifting of the hub and comprises biasing means to prevent lost motion in the rotational direction.

It is another object of the present invention to provide a serial printing apparatus which comprises tongues formed of a thermoplastic resin containing glass or carbon fibers and type members formed of a thermosetting resin.

The above and other objects, features and advantages of the present invention will become clear from the following detailed description taken with the accompanying drawings, in which.

Figure 4:
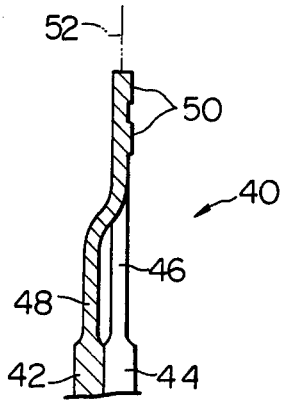
FIG. 4 is a cross section of the type wheel shown in FIG. 3.
Figure 11:
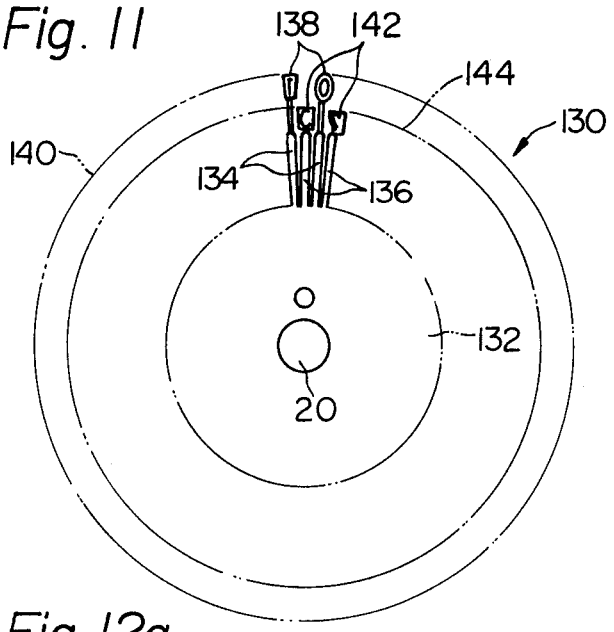
Figure 12A:
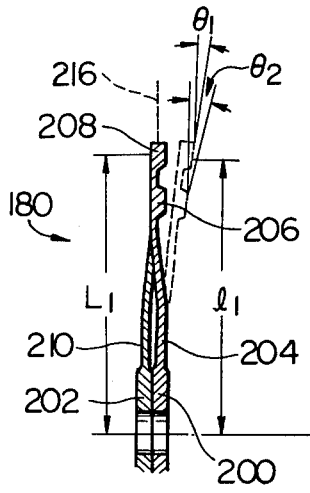
Figure 12B:
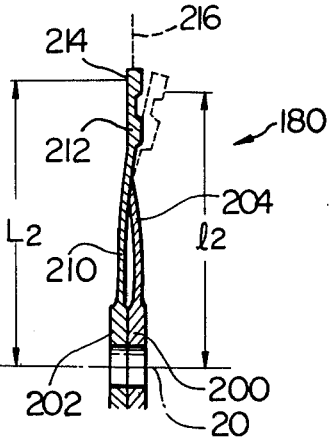
Figure 13:
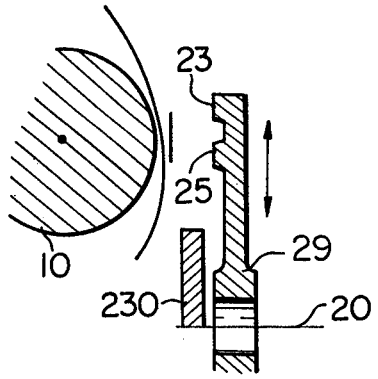
Figure 14:
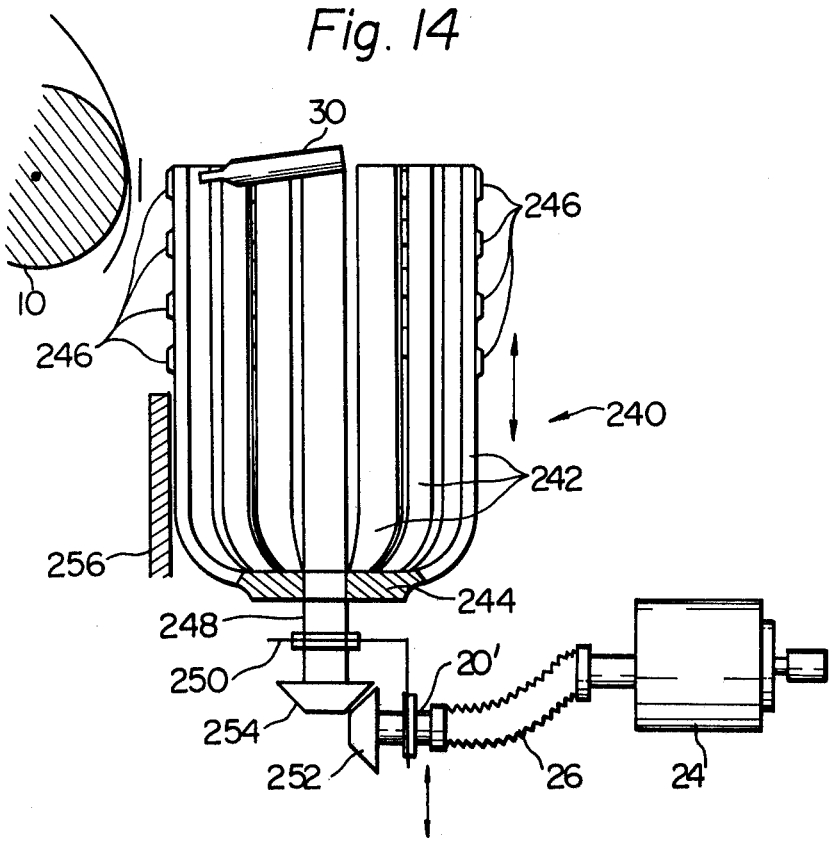

FIG. 11 a fragmentary plan view of another type wheel;

FIG. 12*a* is a cross section of the type wheel shown in FIG. 4 showing deflection of a rightwardly oriented tongue;

FIG. 12*b* is similar to FIG. 12*a* but shows the deflection of a leftwardly oriented tongue;

FIG. 13 is a fragmentary view of a modified embodiment of the invention comprising a stopper member and;

FIG. 14 is similar to FIG. 13 but shows a modified type wheel.

Figure 1:
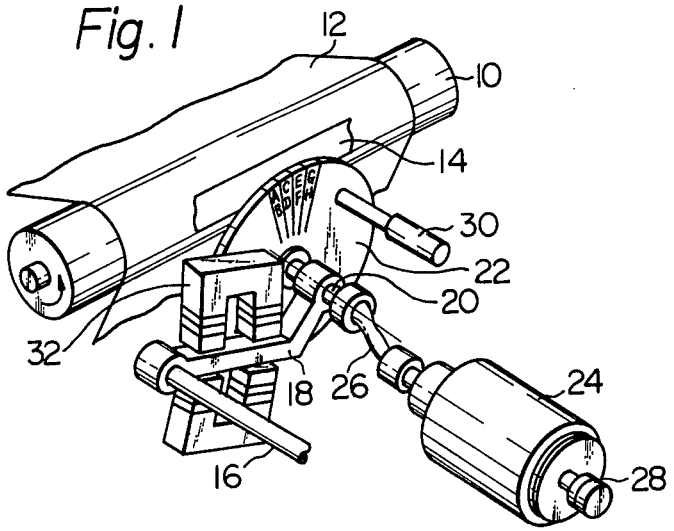
FIG. 1 is a plan view of a serial printing apparatus embodying the present invention.

Referring now to FIG. 1, a serial printing apparatus embodying the present invention comprises a rotary platen 10 which supports a paper 12 on which information is to be printed by the apparatus. An inked ribbon 14 is located in front of the paper 12. A carriage which is not shown supports a shaft 16 which rotatably supports an arm 18. The arm 18 rotatably carries at its end a shaft 20 to which is fixed a type wheel 22. The carriage also supports a rotary drive motor 24, which is connected to the shaft 20 by a universal joint 26. As will be described below, a sensor device 28 is provided to control the motor 24. A hammer 30 is movable with the carriage and is actuated by a mechanism which is not shown. An electromagnet 32 is also movable with the carriage to rotate the arm 18 about the shaft 16 as desired.

Figure 2:
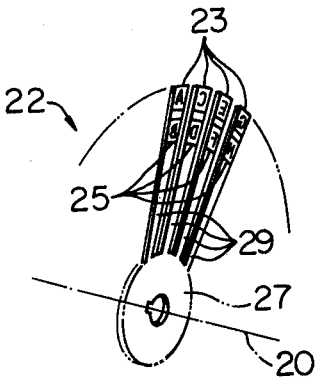
FIG. 2 is a fragmentary plan view of a type wheel for the apparatus shown in FIG. 1.

Referring now to FIG. 2, the type wheel 22 comprises a rotary hub 27 which is fixed to the shaft 20. Resilient tongues 29 extend radially from the hub 27 and carry radially inner type members 25 and radially outer type members 23. The type members 23 and 25 are formed with type faces to print characters. In a typical application, the inner type members 25 may be formed with the upper case Roman alphabet characters and the outer type members 23 may be formed with the lower case Roman alphabet characters. The resilient tongues may be formed of a thermoplastic resin containing glass or carbon fibers.

In operation, the carriage is moved along the axis of the platen 10 by a carriage drive means (not shown) so that the shaft 16, arm 18, electromagnet 32, shaft 20, type wheel 22, motor 24, universal joint 26, sensor device 28 and hammer 30 are moved as a unit. The carriage is stopped at each printing position to print a character. In an application in which the motor 24 is a stepping motor or a servomotor, a character to be printed is selected by a keyboard (not shown) or similar device which sends a rotational signal to the motor 24 and a shift signal to the electromagnet 32. The motor 24 utilizing the sensor device 28 rotates the shaft 20 until the tongue 29 containing the type member with the selected character is in an angular printing position adjacent to the ribbon 14. The electromagnet 32 is energized to attract and rotate the arm 18, shaft 20, and type wheel 22 so that the desired type member 23 or 25 on the selected tongue 29 is in a linear printing position (If the length of the arm 18 is long compared with the spacing between the type members 23 and 25, this movement of the shaft 20 is approximately linear). The hammer 30 is then actuated to drive the selected type member 23 or 25 against the inked ribbon 14 and paper 12 to print the character on the paper 12. It will be noticed that the selected tongue 29 is resiliently bent toward the paper 12 during this process.

The apparatus may be operated in another manner. The motor 24 may be rotated at constant speed and the hammer 30 actuated when the sensor device 28 senses that the selected tongue 29 is in the printing position. In this case, the hammer 30 holds the type member 23 or 25 against the ribbon 14 for a short time so that the tongue 29 must deflect in the rotational direction of the type wheel 22. It will be appreciated that more than two type members may be provided on each tongue, and that the electromagnet 32 or any other shifting means such as a mechanical device may operate directly on the shaft 20 to linearly move the same.

Figure 3:
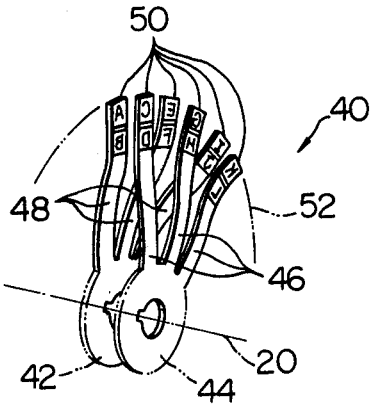
FIG. 3 is similar to FIG. 2 but shows another type wheel.

FIG. 3 shows an alternative embodiment of the type wheel 22. In this case a type wheel 40 comprises two hubs 42 and 44 which are fixed to the shaft 20. Resilient tongues 46 radially extend from the hub 44 and resilient tongues 48 radially extend from the hub 42. Type members which are all designated as 50 are provided on the tongues 46 and 48 so that they all lie in a plane 52 which is perpendicular to the axis of the shaft 20. The type wheel 40 is used in the same manner as the type wheel 22.

The type wheel 40 is shown in cross section in FIG. 4. In the particular form illustrated, the tongues 46 are straight whereas the tongues 48 are bent in a generally Z-shape. The axes of the tongues 46 and 48 are considered to lie in the plane 52 and pass through the axis of the shaft 20. If desired, both of the tongues 46 and 48 may be bent.

Figure 5:
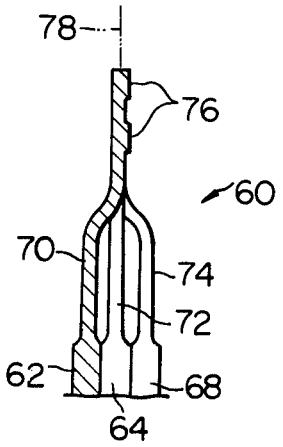
FIG. 5 is a cross section of a modified type wheel.

If desired, more than two hubs may be provided for a type wheel. As shown in FIG. 5, a type wheel 60 comprises hubs 62, 64 and 68 from which resilient tongues 70, 72 and 74 respectively radially extend. Type members 76 are fixed to the tongues 70, 72 and 74. In this embodiment, the tongues 72 are straight whereas the tongues 70 and 74 are bent toward a common plane 78 so that all of the type members 76 lie in the common plane 78. Thus, it is to be noticed that the type wheel provided with two or more hubs makes it possible to reduce the diameter of the type wheel without reducing the width of each tongue or to increase the number of the tongues, so that the inertia moment of the type wheel can be reduced without reducing the rigidity of the tongues and the type wheel can be rotated at a further increased speed.

Figure 6:
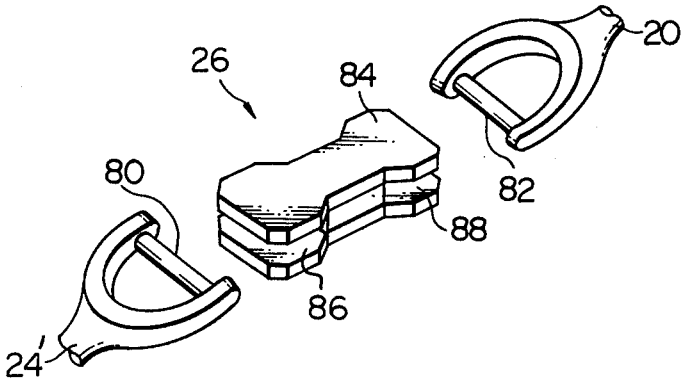
FIG. 6 is an exploded view of a universal joint for the apparatus shown in FIG. 1.
Figure 7:
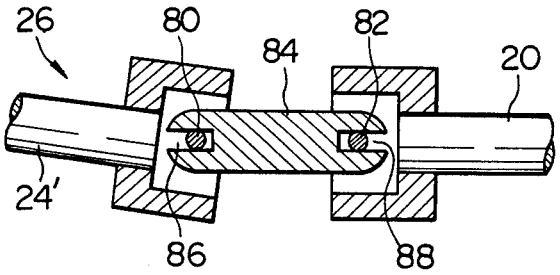
FIG. 7 is a sectional view of a universal joint similar to that shown in FIG. 6.

A first embodiment of the universal joint 26 is shown in FIG. 6, and comprises a transverse pin on pin member 80 connected to a bifurcated end of a shaft 24' of the motor 24. A similar pin or pin member 82 is connected to a bifurcated end of the shaft 20. A link 84 is provided with slots 86 and 88 in which the pins 80 and 82 respectively are slidably received. The universal joint 26 thereby rotatably connects the pins 80 and 82 and shafts 24' and 20 together and allows the shaft 20 to be moved in its shifting direction since the pins 80 and 82 can slide in the slots 86 and 88 in the direction of the axis of the link 84. The universal joint 26 is shown in cross section in FIG. 7, and is modified in the respect that the pins 80 and 82 are connected to tubular ends rather than bifurcated ends of the shafts 24' and 20.

Figure 8:
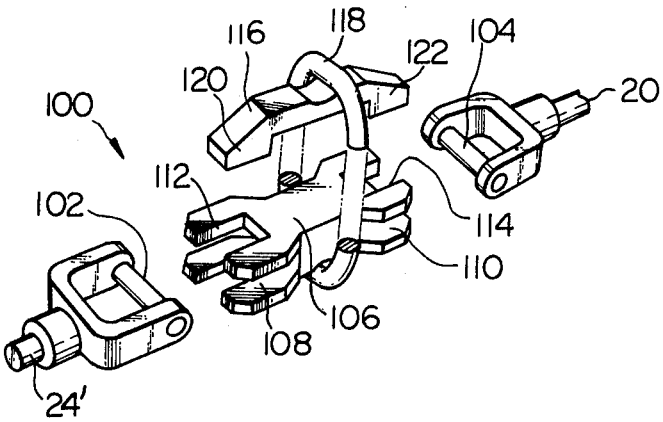
FIG. 8 is an exploded view of another universal joint.
Figure 9:
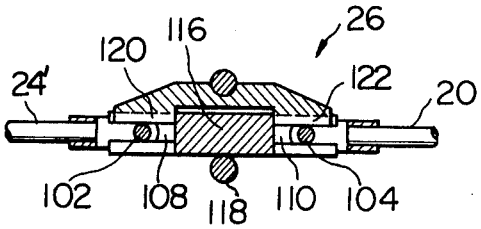
FIG. 9 is a cross section of the universal joint shown in FIG. 8.
Figure 10:
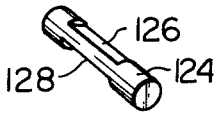
FIG. 10 is a plan view of a pin for the universal joint shown in FIG. 9.

FIG. 8 shows an improvement to the universal joint 26 which is designed to prevent lost motion or backlash in the rotational direction which might be caused by wear of the pins 80 and 82 in the slots 86 and 88. A universal joint 100 comprises pins 102 and 104 connected to bifurcated ends of the shafts 24' and 20 respectively. A link 106 is formed with slots 108 and 110 in which the pins 102 and 104 are slidably received in the same manner as the universal joint 26. The link 106 is, however, formed with slots 112 and 114 which perpendicularly intersect the slots 108 and 110 respectively. A presser member 116 is urged downward by an elastic ring 118 so that arms 120 and 122 of the presser member 116 engage with the pins 102 and 104 respectively and press them against the bottom walls of the slots 108 and 110 respectively. In this manner, even if the pins 102 and 104 wear, the wear will be compensated for by the presser member 116 and elastic ring 118 so that no backlash will exist in the rotational direction of the universal joint 100. The universal joint 100, which is shown in cross section in FIG. 9, may be modified so that the pins 102 and 104 are replaced by pins shaped like a pin 124 which is shown in FIG. 10. In this case, the pins would be rotatably mounted to the shafts 24' and 20. The pin 124 is formed with diametrically opposed flat surfaces 126 and 128 to prevent rotation of the pins in the slots 108 and 110 and thereby reduce the wear on the pins.

FIG. 11 shows a type wheel 130 which comprises a hub 132 fixed to the shaft 20. Long tongues 134 and short tongues 136 radially extend from the hub 132. Type members 138 are fixed to the long tongues 134 and are arranged along a circle 140. Type members 142 are fixed to the short tongues 136 and lie on a concentric radially inner circle 144. The operation of this type wheel 130 is quite similar to that of the type wheel 22. This type wheel 130 is advantageous for printing on flat surfaces such as passbooks since it overcomes the problem of ghost images. In addition, two or more type wheels 130 may be provided in a way shown in FIGS. 3 and 4 or FIG. 5.

In FIGS. 12*a* and 12*b*, a type wheel 180 comprises a right hub 200 and a left hub 202. Resilient tongues 204 radially extend from the hub 200 and carry radially inner and outer type members 206 and 208. Resilient tongues 210 radially extend from the hub 202 and carry radially inner and outer type members 212 and 214. The tongues 204 and 210 are bent so that all of the type members lie in a common plane 216. Characters are formed on right type faces of the type members as viewed in FIGS. 12*a* and 12*b*.

In order for the apparatus to provide optimum printing, it is necessary for the type members to all strike the paper 12 at the same point and that the right type faces thereof be perpendicular to the platen 10 on impact. In FIG. 12*a*, one of the tongues 204 is shown as bent rightward to a broken line position in which it strikes the paper 12. The distances from the axis of the shaft 20 to the center of the type member 208 in the undeformed and deformed positions are designated as $L_1$ and $l_1$ respectively. The equivalent distances for the type member 214 in FIG. 12*b* are $L_2$ and $l_2$ respectively. It will be noticed that $L_1$-$l_1$ is less than $L_2$-$l_2$, since the tongue 204 is unbent and the tongue 210 is bent to perform printing. Since $l_1$ must be equal to $l_2$ so that the type members 208 and 214 will strike the paper 12 at the same point, it follows that $L_2$ must be greater than $L_1$. The same relationship holds for the type members 206 and 212.

In order for the type members to all strike the paper 12 at the same angle, an angle $\theta_2$ between the right face of the type member 206 and the plane 216 at the point of impact must be larger than an angle $\theta_1$ between the right face of the type member 208 at the point of impact. In this connection, it is necessary to uniformly apply the same impact to type member through the length and breadth thereof when the type member is driven by the hammer against the paper to print. In order to accomplish this, the type members 208 and 206 are formed in a manner that an angle $\theta_3$ between the back face of the type member 208 and the plane 216 at the point of impact is equal to the angle $\theta_1$, while an angle $\theta_4$ between the back face of the type member 206 and the plane 216 at the point of impact is equal to the angle $\theta_2$, so that the hammer is perpendicular to the back face of the type members 208 or 206 on impact.

FIG. 13 teaches the use of a stopper member 230 against which the bottom portion of the selected tongue 29 is abuttable when moved by the hammer 30. The stopper member 230 is employed to provide the same bending characteristics for the tongue 29 no matter which type member 23 or 25 is selected.

FIG. 14 shows a modified type wheel 240 in which tongues 242 are bent at right angles to a hub 244 to define a cylindrical shape. Type members 246 are fixed to the tongues 242. The hub 244 is fixed to a shaft 248 which is rotatably supported by a carriage member 250 movable with the carriage. The carriage member 250 is movable along the axis of the platen 10 and also vertically to select a desired type member 246 on the selected tongue 242. The shaft 248 and thereby the type wheel 240 are rotatable from the motor 24 by means of the universal joint 26, a shaft 20', and bevel gears 252 and 254. The bevel gear 252 is fixed to the shaft 20' which is rotatably supported by the carriage member 250 and the bevel gear 254 which meshes with the bevel gear 252 is fixed to the shaft 248. A stopper member 256 is provided in the same manner as the stopper member 230.

Many modifications to the apparatus shown will be possible for those skilled in the art without departing from the scope of the invention after receiving the teachings of the present disclosure.

What is claimed is:

1. Printing apparatus comprising, in combination:

at least two rotary hubs rotatable and shiftable to a printing position;

a plurality of resilient tongues extending generally radially from each of the rotary hubs;

type members provided on the tongues at predetermined distances from the rotary hubs;

first drive means for rotating the rotary hubs so that a selected one of the tongues is in a predetermined angular position;

a second drive means for moving the rotary hubs in a direction parallel to an axis of the selected tongue so that a selected type member on the selected tongue is in a predetermined linear position, and a universal joint comprising a first member connected to the first drive means, a second member connected to the rotary hubs, and link means comprising a link formed with first and second slots to receive the first and second members respectively, a presser member, and biasing means urging the presser member to engage with the first and second members perpendicular to the axes thereof and press the first and second members against inner walls of the link defining the first and second slots, whereby to compensate for movement of the rotary hub by the second drive means.

2. Printing apparatus comprising, in combination:

at least two rotary hubs rotatable and shiftable to a printing position;

a plurality of resilient tongues extending generally radially from the rotary hubs;

type members provided on the tongues at predetermined distances from the rotary hubs;

first drive means for rotating the rotary hubs so that a selected one of the tongues is in a predetermined angular position;

second drive means for moving the rotary hubs in a direction parallel to an axis of the selected tongue so that a selected type member on the selected tongue is in a predetermined linear position, and a universal joint comprising a first pin member connected to the first drive means, a second pin member connected to the rotary hubs, link means comprising a link formed with first and second slots to receive the first and second pin members respectively, a presser member, and biasing means in the form of an elastic band extending around the link means and the presser member.

3. The printing apparatus according to claim 2, in which the first drive means comprises a stepping motor.

4. The printing apparatus according to claim 2, in which the first drive means comprises a servomotor.

5. The printing apparatus according to claim 2, further comprising a stop member disposed adjacent to the selected tongue.

6. The printing apparatus according to claim 2, in which the resilient tongues are formed of a thermoplastic resin.

7. The printing apparatus according to claim 2, in which the resilient tongues comprise glass fibers.

8. The printing apparatus according to claim 2, in which the resilient tongues comprise carbon fibers.

9. The printing apparatus according to claim 6, in which the thermoplastic resin comprises amide resin.

10. The printing apparatus according to claim 2, in which the first and second pin members are rotatably connected to the first drive means and the rotary hubs respectively.

11. The printing apparatus according to claim 10, in which the first and second pin members are formed with diametrically opposed flat surfaces.

12. Printing apparatus comprising, in combination:

at least one rotary hub rotatable and shiftable to a printing position;

a plurality of resilient tongues extending generally radially from the rotary hub, type members provided on the tongues at predetermined distances from the rotary hub;

first drive means for rotating the rotary hub so that a selected one of the tongues is in a predetermined angular position;

second drive means for moving the rotary hub in a direction parallel to an axis of the selected tongue so that a selected type member on the selected tongue is in a predetermined linear position; and a universal joint comprising a first member connected to the first drive means, a second member connected to the rotary hub and link means comprising a link formed with first and second slots to receive the first and second members respectively, a presser member, and biasing means urging the presser member to engage with the first and second members perpendicular to the axes thereof and press the first and second members against inner walls of the link defining the first and second slots, whereby movement of the rotary hub is compensated for by the second drive means.

* * * * *